United States Patent [19]

Boyd

[11] 4,269,206

[45] May 26, 1981

[54] LIGHTED HAND MIRROR

[76] Inventor: Raymond Boyd, 2235 Cambridge Rd., Broomall, Pa. 19008

[21] Appl. No.: 70,916

[22] Filed: Aug. 29, 1979

[51] Int. Cl.[3] ..... B65D 1/34

[52] U.S. Cl. ..... 132/79 F; 362/156

[58] Field of Search ..... 132/79 F, 79 G; 362/154, 155, 156, 135, 136, 146

[56] References Cited

U.S. PATENT DOCUMENTS

| | | | |
|---|---|---|---|
| 1,882,073 | 10/1932 | Freed | 362/156 |
| 1,889,143 | 11/1932 | Hirsh | 362/155 |
| 3,609,341 | 9/1971 | Castaldo | 362/156 |
| 3,937,320 | 2/1976 | Chao et al. | 362/155 |

*Primary Examiner*—Robert A. Hafer

*Attorney, Agent, or Firm*—Benasutti Associates, Ltd.

[57] ABSTRACT

A lighted hand mirror includes a case member having a battery, electric lights and a switch therein. Pivotally connected to the case member is a cover member of complementary peripheral configuration which carries a mirror thereon and light diffusing means adjacent thereto which overlies the electric lights when the cover is in place over the case member. A cam carried by the hinge between the case and cover members engages the switch to turn the same on or off. A tab extends from the cam to allow it to be manually and selectively pivoted between the on and off positions.

7 Claims, 4 Drawing Figures

LIGHTED HAND MIRROR

BACKGROUND OF THE INVENTION

This invention relates to a lighted hand mirror and more particularly to a lighted mirror which includes a battery source and light bulbs operated by the battery for illuminating the user's face.

While small portable lighted mirrors have been known for some time, the prior art devices known to Applicant are generally in the form of a compact. That is, they include a lower case member and a cover hinged thereto and the mirror is not visible unless the cover is opened. One such device is shown, for example, in Applicant's prior U.S. Pat. No. 4,126,145.

Applicant's prior patent has met with considerable commercial success. Nonetheless, devices constructed in accordance with this prior patent are relatively expensive because of the number of components involved. Even further, Applicant's prior device requires the use of two hands to at least initially open the compact.

There are also prior art lighted mirrors presently on the market which utilize a plurality of electric light bulbs and which are intended to be used on a dressing table or the like. These prior devices are relatively large and require a 120 volt power source. They are, therefore, impossible to be used as a portable lighted mirror which can be carried in a handbag.

Applicant believes that there is a need for a relatively small and inexpensive lighted hand mirror which can be carried in a person's pocket or purse. It is not believed that the prior devices discussed above fully or adequately satisfy this need.

SUMMARY OF THE INVENTION

It is believed that the present invention satisfies the need discussed above. This is accomplished by a lighted hand mirror which includes a case member having a battery, electric lights and a switch therein. Pivotally connected to the case member is a cover member of complementary peripheral configuration which carries a mirror thereon and light diffusing means adjacent thereto which overlies the electric lights when the cover is in place over the case member. A cam carried by the hinge between the case and cover members engage the switch to turn the same on or off. A tab extends from the cam to allow it to be manually and selectively pivoted between the on and off positions.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
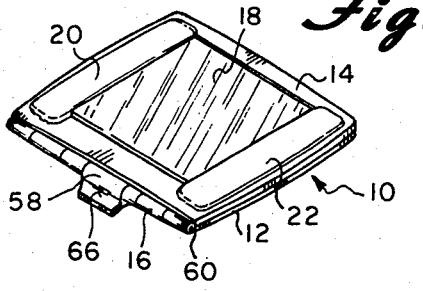
FIG. 1 is a perspective view of a lighted hand mirror constructed in accordance with the principles of the present invention.
Figure 2:
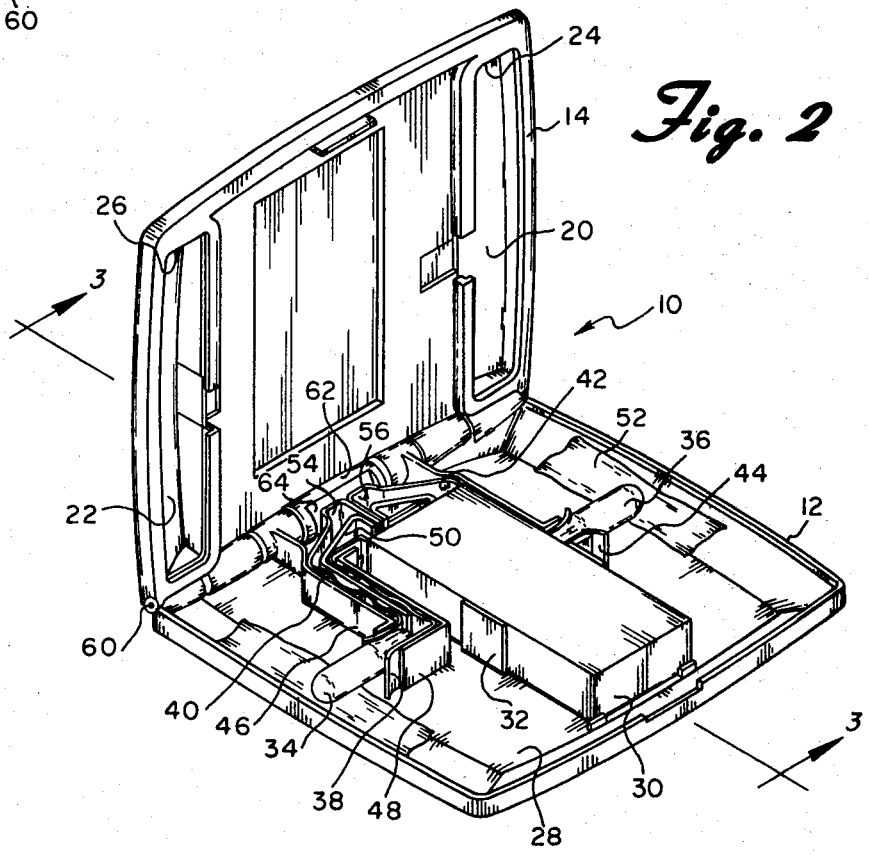
FIG. 2 is a perspective view of the device shown in FIG. 1 but being shown with the cover in its open position to expose the interior of the device.

Referring now to the drawings in detail wherein like reference numerals have been used throughout the various figures to designate like elements, there is shown in FIGS. 1 and 2 a lighted hand mirror constructed in accordance with the principles of the present invention and designated generally as 10. Hand mirror 10 is comprised essentially of two main components: the bottom case member 12 and the cover member 14 which are hinged together by hinge means 16 at one edge thereof so that the bottom case member 12 and cover member 14 may be pivotally opened and closed as shown in FIGS. 1 and 2. Since the peripheral configuration of the bottom case member 12 and the cover member 14 are complementary, the lighted hand mirror 10, when closed, forms a substantially unitary structure.

Mounted on the upper outer surface of the cover member 14 is a conventional mirror 18. To either side of the mirror 18 are mounted elongated translucent elements 20 and 22. As shown most clearly in FIG. 2, openings 24 and 26 are formed in the cover member 14 behind the translucent elements 20 and 22, respectively. As will be more apparent hereinafter, this allows light from the bulbs mounted in the bottom case member 12 to shine through the translucent elements 20 and 22.

The bottom case member 12 has mounted on the inside surface 28 thereof a relatively flat battery 30. A plurality of upwardly extending ribs such as 32 maintain the battery 30 in its proper location. Battery 30 may be, for example, a No. 9K62 manufactured by P. R. Mallory Co., Inc. Also mounted within the bottom case member 12 are electric light bulbs 34 and 36. Bulbs 34 and 36 are of the type which have a flat glass base having electrical contacts on the opposite surfaces thereof. Bulbs 34 and 36 are wired to the battery 30 through elongated flat springlike wires 38, 40, 42 and 44. A plurality of raised guide members such as shown at 46 and 48 form a channel which guides the wires 38 and 40 toward the battery. A divider 50 runs between the guide members 46 and 48 and between the wires 38 and 40 to help guide the same and to prevent the wires from shorting. Similar guide members and a similar divider are associated with bulb 36 and wires 42 and 44.

The ends of the guide members 46 and 48 adjacent the bulb 34 also function as the socket for the bulb. It should be noted that the divider 50 stops short of the ends of the members 46 and 48. The wires 38 and 40, however, continue substantially to the end of the channel. Bulb 34 is merely pushed into the space between the members 46 and 48 so that the wires 38 and 40 contact the sides of the base of the bulb. Again, a similar arrangement on the other side of the bottom case member serves as a socket for bulb 36. Preferably also, a reflective material such as shown at 52 is mounted beneath the bulbs.

Wires 40 and 42 also serve as the switch for turning the bulbs 34 and 36 on and off. As shown in FIG. 2, wires 40 and 42 are first bent outwardly away from the battery 30 and are then again bent inwardly toward the battery to form projecting bulges 54 and 56. The ends of the wires 40 and 42, therefore, can be moved into or out of engagement with the terminal at the end of the battery 30 to complete the electrical circuit to the bulbs 34 and 36 by moving bulges 54 and 56 toward or away from the end of the battery. Thus, the bulges 54 and 56 may be considered as actuating means for the switch mechanism of the invention.

The entire electrical circuit just described is substantially identical to the arrangement shown in Applicant's prior U.S. Pat. No. 4,126,145. Thus, reference can be had to that patent for a more detailed view and description of the electrical circuit should the same be deemed necessary; the subject matter of U.S. Pat. No. 4,126,145 is hereby incorporated herein by reference.

As explained in Applicant's prior patent, the actuating means for the switch therein were moved by a cam carried by the compact cover shown therein. While the present invention does not include a compact cover, it is provided with a similar cam for moving the ends of the wires 40 and 42 for completing the electrical circuit to illuminate the bulbs 34 and 36.

Figure 3:
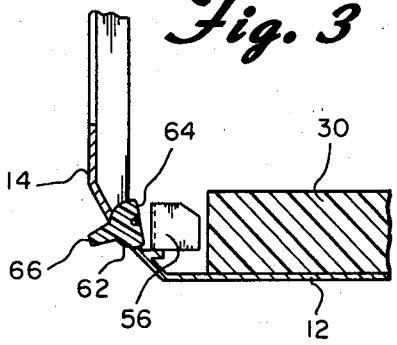
FIG. 3 is a cross-sectional view taken through the line 3—3 of FIG. 2 and showing the switch in the open position.
Figure 4:
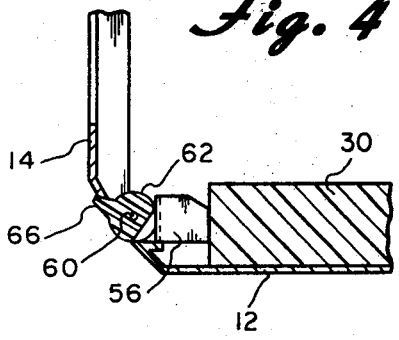
FIG. 4 is a view similar to FIG. 3 but showing the switch in the close position.

Axially aligned with the hinge means 16 in the approximate center of the hinged ends of the bottom case member 12 and the cover member 14 is a cam element 58. Cam element 58 is mounted on the pin or axle 60 which passes through the entire hinge element 16. Cam element 58 includes a rounded portion 62 and a relatively flat cutaway portion 64. Thus, as can be most clearly seen in FIGS. 3 and 4, when the cam is in a first position wherein the flat portion 64 is opposite the bulges 54 and 56, the electrical circuit is not completed and the bulbs are not lit. However, when the cam element is rotated so that the rounded portion 62 is in contact with the bulges 54 and 56, the ends of the wires 40 and 42 are forced into contact with the terminal at the end of the battery 30 and the bulbs 34 and 36 are lit. Movement of the cam 58 is facilitated by a tab element 66 which extends outwardly from the end of the lighted hand mirror 10. Wires 40 and 42 are, of course, made of a spring-like material so that they will return to their normal position wherein the ends are out of engagement with the terminal of battery 30 when the cam 58 is in its intermediate position with the flat portion 64 opposite the bulges 54 and 56.

The present invention may be embodied in other specific forms without departing from the spirit or essential attributes thereof and accordingly, reference should be made to the appended claims rather than to the foregoing specification as indicating the scope of the invention.

I claim:

1. A lighted hand mirror comprising:

a shallow bottom case member;

a shallow cover member having a configuration complementary to the peripheral configuration of said bottom case member;

hinge means joining said bottom case member and said cover member, so that said bottom member and said cover member are movable between an open position and a closed position;

a mirror carried by said cover member;

light diffusing means positioned on said cover member adjacent said mirror;

a battery positioned within said bottom case member;

electrically operated illuminating means within said bottom case member and being positioned so as to lie behind said light diffusing means when said bottom case member and said cover member are in said closed position;

switch means within said bottom case member and including movable actuator means;

circuit means electrically interconnecting said battery, said illuminating means and said switch means;

a cam element, axially aligned with, and pivotally mounted on part of, said hinge means, and including a cam surface adapted to engage said actuator means for alternately moving the same between an off position and an on position when said cam element is pivoted, and a tab means extending from said cam element externally of said bottom case member and said cover member for manually pivoting said cam element.

2. A lighted hand mirror as claimed in claim 1 wherein said actuator means is movable in a plane substantially parallel to the plane of said case member.

3. A lighted hand mirror as claimed in claim 1 wherein said circuit means includes substantially flat metal strips and wherein channel means are provided within said case member for maintaining said flat metal strips in their proper position.

4. A lighted hand mirror as claimed in claim 3 wherein said switch means and actuator means includes part of said flat metal strips.

5. A lighted hand mirror as claimed in claim 4 wherein part of said flat metal strips function as socket means for said illuminating means.

6. A lighted hand mirror as claimed in claim 4 wherein said battery has a terminal at one end thereof and wherein said switch means is comprised of part of said flat metal strips being movable by said cam surface toward said terminal to make an electrical contact directly therewith.

7. A lighted hand mirror as claimed in claim 5 wherein said socket means is comprised of a pair of flat metal strips spaced apart and wherein said illuminating means includes a substantially flat base having an electrical terminal on opposite surfaces thereof, said base being positioned between said spaced apart flat metal strips.

* * * * *